United States Patent [19]

Piesche

[11] Patent Number: 4,721,937

[45] Date of Patent: Jan. 26, 1988

[54] TEMPERATURE RESPONSIVE SWITCH

[75] Inventor: Günter Piesche, Ubstadt-Weiher, Fed. Rep. of Germany

[73] Assignee: Ranco Incorporated, Dublin, Ohio

[21] Appl. No.: 883,014

[22] Filed: Jul. 8, 1986

Related U.S. Application Data

[63] Continuation of Ser. No. 601,557, Apr. 18, 1984, abandoned.

[30] Foreign Application Priority Data

Apr. 27, 1983 [DE] Fed. Rep. of Germany ..... 8312296

[51] Int. Cl.[4] ..... H01H 37/40; H01H 35/34

[52] U.S. Cl. ..... 337/321; 200/83 N

[58] Field of Search ..... 73/118, 708; 200/83 A, 200/83 L, 83 D, 83 N; 337/117-120, 306, 320, 321

[56] References Cited

U.S. PATENT DOCUMENTS

| | | | |
|---|---|---|---|
| 2,648,741 | 8/1953 | Starbird | 337/320 |
| 3,742,165 | 6/1973 | Hellman | 200/83 A |
| 3,760,396 | 9/1973 | Haselton | 200/83 N |
| 3,809,835 | 5/1974 | Watt | 200/83 N |
| 3,882,439 | 5/1975 | Wolfe | 337/321 |
| 4,535,209 | 8/1985 | Korz | 200/83 N |
| 4,563,902 | 1/1986 | Kohnlechner | 73/708 |

FOREIGN PATENT DOCUMENTS

| | | |
|---|---|---|
| 2449328 | 12/1980 | France . |
| 2488039 | 5/1982 | France . |
| 700051 | 11/1953 | United Kingdom . |
| 2001475 | 1/1979 | United Kingdom . |

OTHER PUBLICATIONS

SAE Journal, vol. 75, No. 5, May 1965, pp. 80-81, New York, U.S.; D. L. Van Ostrom: "Vapor Pressure Comparator Will Operate Satisfactorily Under Abnormal Conditions".

*Primary Examiner*—Stewart J. Levy
*Assistant Examiner*—Robert R. Raevis
*Attorney, Agent, or Firm*—Watts, Hoffmann, Fisher & Heinke

[57] ABSTRACT

A temperature responsive switch includes a housing(1) which can be secured to the engine block of a motor vehicle and a temperature sensitive element (4) which is in contact with the cooling medium of the motor. In order to guarantee switching dependent on the temperature (T) and the pressure (P) of the cooling medium, in the housing (1) a hermetically sealed bellows-capillary-unit (4) is disposed which responds to temperature (T) and pressure (P) of the cooling medium and around which the cooling medium circulates, being sealed against the housing portion through which the cooling medium flows, a movable switching contact (6) mounted on the bellows-capillary-unit (4) is disposed in a room (7) open towards the atmosphere and covered by a cover (8) and a fixed switching contact is disposed in said cover (8), and the bellows-capillary-unit (4) is filled with a liquid having a vapor pressure curve of between about 1,2 bar at 96° C. and 1,8 bar at 110° C.

1 Claim, 2 Drawing Figures

TEMPERATURE RESPONSIVE SWITCH

Figure 1:
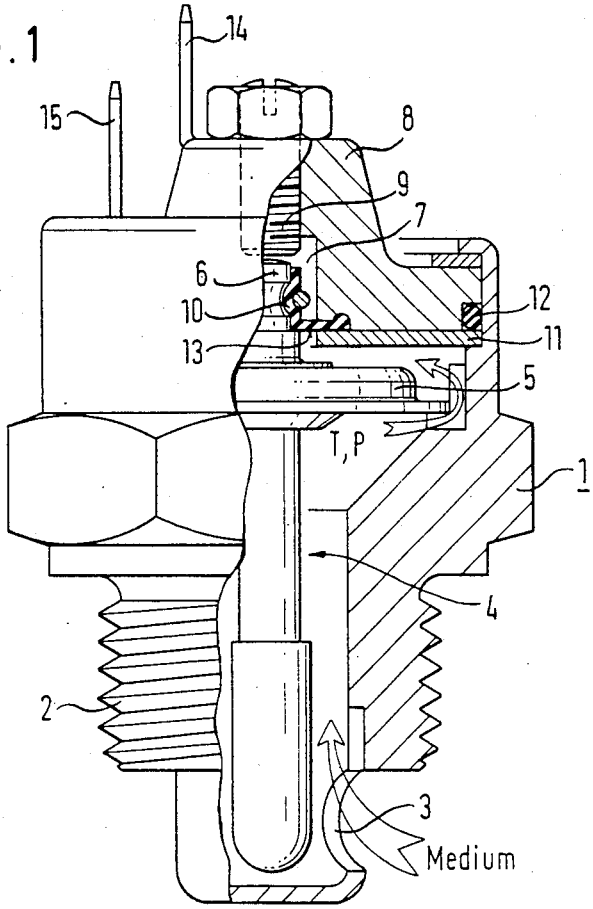

This application is a continuation of application Ser. No. 601,557, filed 4/18/84, now abandoned.

The invention relates to a temperature responsive switch, the housing of which can be secured the engine block of a motor vehicle and the temperature sensitive element of which is in contact with the cooling medium of the motor.

Instead of a temperature display instrument mounted in the instrument board in a manner visible to the driver, various manufacturers of motor vehicles use a lamp which is switched by such a temperature switch secured to the engine block and located in the cooling medium, said lamp showing an exceeding of the permissable motor temperature by illumination at a cooling medium temperature of about 110° C. In the cooling system of the motor, during the operation thereof there generally prevails an overpressure of about 1.8 bar absolute. Since the boiling point of water or water mixed with an anti-freeze means, which represent the cooling medium, is pressure dependent, upon loss of cooling medium, as a result of the lower pressure connected therewith, boiling can already occur before the known temperature switch responds.

The invention is based on the object of providing a switch of the above described species with which, in a simple manner, it is guaranteed that the switching takes place dependent on pressure at different limiting temperatures of the cooling medium and accordingly erroneous information with respect to the exceeding of the permissable motor temperature is reliably avoided.

According to the invention, this object is solved in that in the housing, a hermetically sealed bellows-capillary-unit responding to the temperature of the cooling medium and the pressure in the cooling medium is disposed, around which the cooling medium circulates, that the bellows-capillary-unit is sealed against the housing portion through which the cooling medium flows, that a movable switching contact mounted on said bellows-capillary-unit is disposed in a chamber covered by a cover and open towards the atmosphere, and in said cover a fixed switching contact is disposed, and that the bellows-capillary-unit is filled with a liquid having a vapor pressure curve of between about 1.2 bar at 96° C. and 1.8 bar at 110° C.

If the temperature of the cooling medium is increased, then the bellows of the bellows-capillary-unit used as temperature sensitive element expands by the increase of the vapor pressure present in said bellows in the direction of the fixed contact, whereby finally the switch closes. The pressure in the cooling medium works in the opposite direction, i.e. in the direction of the contact opening, whereby the responding temperature of the switch is lower, the lower the pressure.

It is advantageous to seal the cover by an O-ring against the housing and by a flexible sealing ring against the bellows-capillary-unit, whereas the O-ring and the flexible sealing ring are expediently held onto the cover by an annular disc.

The fixed circuit contact is advantageous constructed as an adjustable contact screw.

Expediently an electrical terminal is mounted on the cover which is insulated against the same and which is in connection with the fixed switching contact, whereas the movable switching contact can be connected conductively with the housing and with a further electrical terminal.

The housing expediently includes an inlet port for the cooling medium at the end remote from the movable switching contact.

The housing advantageously has a screw thread to be screwed into the engine block of the motor vehicle.

Figure 2:
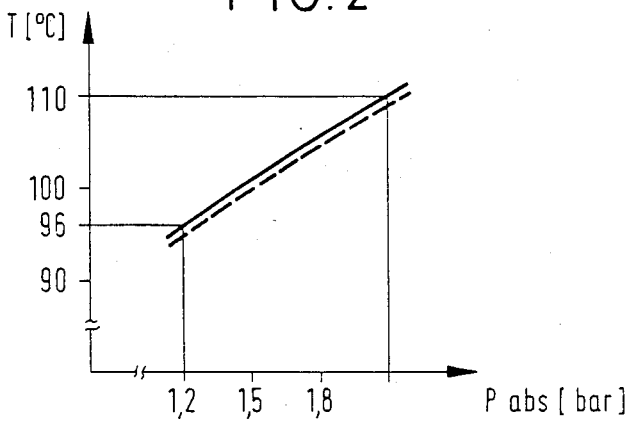

The invention is explained in more detail in the following in an embodiment on the basis of the drawings. In the drawings FIG. 1 shows a pressure sensitive temperature switch according to the invention, partially in longitudinal section, and FIG. 2 shows a section from a curve corresponding with the vapor pressure curve of the liquid, with which the bellows-capillary-unit of the switch according to FIG. 1 is filled.

The switch represented in the drawings shows a housing 1 with a screw thread 2 for screwing the housing 1 into the engine block of a motor vehicle. At the lower end of the housing 1, an inlet port 3 for the inlet of the cooling medium from the engine block of the motor vehicle is provided.

A bellows-capillary-unit 4 with a bellows 5 is provided stationary in the housing 1. At the upper end of the bellows-capillary-unit 4, a movable switching contact 6 is mounted in a chamber 7 open towards the atmosphere. The chamber 7 is covered by a cover 8 secured on or in, respectively, the housing 1. In the cover 8, a fixed switched contact 9 is mounted in the form of an adujustable contact screw.

The portion of the housing 1 through which the cooling medium flows with the temperature T and the pressure P and the bellows-capillary-unit 4 is sealed against the chamber 7 under atmospheric pressure by means of a flexible sealing ring 10, an annular disc 11, an O-ring 12 and the cover 8. Thus, the electrically conductive cooling medium cannot penetrate into the chamber 7, in which the switching contacts 6 and 9 are located.

The hermetically sealed bellows-capillary-unit 4 is filled with a liquid, the vapor pressure curve of which corresponds with the curve shown in FIG. 2, less a small pressure portion which occurs on the sealing area 13 of the flexible sealing ring 10. With such a filling of the bellows-capillary-unit 4 the switching point of the switch lies in a range of temperature T of the cooling medium of 96° C. to 110° C. and responsive to the pressure P of the cooling medium between 1.2 bar absolute and 1.8 bar absolute.

On the cover 8 an electrical terminal 14 is mounted which is insulated against the same and which is connected with the fixed switching contact 9. The movable switching contact 6 is connected conductively with the housing 1 and a further electrical terminal 15.

The function of the switch represented in the drawing is the following: If the temperature T of the cooling medium increases, then on account of the increase of the vapor pressure in the bellows-capillary-unit 4, the bellows 5 expands in the direction of the fixed switching contact 9 so that finally the movable switching contact 6 on the bellows-capillary-unit 4 comes into contact with the fixed switching contact 9 and thus closes the switch. The pressure P in the cooling medium works on the bellows 5 in opposite direction, i.e. in the switch opening direction, so that upon higher pressure P in the cooling medium, the switch only closes upon a higher temperature T of the cooling medium.

The vapor pressure curve of the liquid in the bellows-capillary unit 4 is selected so that after adjustment of the contact screw serving as fixed switching contact 9, e.g. at 96° C. and 1.2 bar in the cooling medium, the switch closes and moreover the closing of the switch follows the curve represented in the diagram in FIG. 2. Upon an increase of the pressure or reduction of the temperature in the cooling medium, the switch will reopen displaced by a hysteresis, which is indicated in FIG. 2 by a dotted curve.

I claim:

1. A device for producing an indication of excessive coolant temperature in an automotive vehicle engine through a predetermined range of superatmospheric coolant pressures comprising:

(a) a support housing fixed with respect to said engine, said support housing defining structure for detachably engaging said engine for positioning said housing with an end portion projecting into coolant in said engine, a port defined in said housing end portion for admitting engine coolant to an internal portion of said housing, and with said housing defining a chamber portion separate from said internal housing portion communicated with said coolant;

(b) a hermetic bellows-capillary unit supported by said housing, said unit comprising:

(i) a bellows comprising a rigid peripheral portion defining an axially extending flange, said flange engaged and supported by said housing, said bellows supported in a position where coolant in said internal housing portion substantially surrounds said bellows so that changes in coolant pressure result in extension and retraction of said bellows, said bellows comprising an extension element projecting from said bellows into said chamber;

(ii) a capillary tube extending from said bellows oppositely from said extension element into engine coolant in said internal housing portion in the vicinity of said port, said capillary tube being substantially axially aligned with said housing end portion such that said tube is substantially surrounded by coolant so that the temperature of said capillary tube is substantially the same as the temperature of the engine coolant in the vicinity of said housing;

(iii) a vaporizable fluid in said bellows and capillary tube, said fluid exhibiting a vapor pressure of about 1.2 bar at 96° C. and 1.8 bar at 110° C. so that increasing fluid vapor pressure in said bellows-capillary unit created by increasing coolant temperature adjacent said capillary tube tends to extend said bellows in opposition to the coolant pressure exerted on said bellows by coolant surrounding said bellows in said housing;

(c) switch means actuatable by said bellows for providing an indication of excessive engine coolant temperature, said switch means disposed in said housing chamber portion adjacent said bellows; and, (d) sealing means for sealing said housing chamber portion against ingress of engine coolant from the vicinity of said bellows-capillary unit, said sealing means comprising a flexible sealing ring including a peripheral portion sealingly clamped to said housing and extending from said housing and sealingly clamped to said bellows extension element, said sealing ring allowing relative axial movement betwen said housing and said bellows extension member without the need for sliding engagement between said extension member, said sealing ring or said housing, whereby hysteresis is minimized;

(e) said bellows-capillary unit responding to the pressure of engine coolant surrounding said bellows and coolant temperature to actuate said switch means for providing an excessive temperature indication dependent upon engine coolant temperature and pressure conditions.

* * * * *